United States Patent [19]

Pasfield

[11] Patent Number: 5,026,084

[45] Date of Patent: Jun. 25, 1991

[54] COLOR CARE CODED PATIENT IDENTIFICATION SYSTEM

[76] Inventor: Gail Pasfield, 28 Orchard Dr., Woodbury, N.Y. 11797

[21] Appl. No.: 582,145

[22] Filed: Sep. 14, 1990

[51] Int. Cl.[5] ..... G09F 3/14

[52] U.S. Cl. ..... 283/75; 283/74; 283/114; 40/633

[58] Field of Search ..... 283/114, 74, 75, 70, 283/900, 81; 40/633

[56] References Cited

U.S. PATENT DOCUMENTS

| | | | |
|---|---|---|---|
| 4,386,795 | 6/1983 | Charles et al. | 283/75 |
| 4,612,718 | 9/1986 | Golub et al. | 40/633 |
| 4,616,436 | 10/1986 | De Woskin | 40/633 |
| 4,682,431 | 7/1987 | Kowalchuk | 40/633 |

OTHER PUBLICATIONS

"Color-Coded Band" from Ready Made Buyers Guide, p. 20, 1989.

"Color-Coded Chart for Alert Condition" from Ready Made Buyers Guide, p. 40, 1989.

"A Plurality of Color-Coded Bands" from Jacobs Gardner Office Product, p. 741, 1988.

"A Strip of Pin-Feed Computer Paper with Paper Bands Adhered Thereon" from Jacobs Gardner Office Products, p. 432, 1988.

*Primary Examiner*—Douglas D. Watts

*Assistant Examiner*—Hwei-Siu Payer

*Attorney, Agent, or Firm*—James P. Malone

[57] ABSTRACT

A color coded band, adapted to be mounted on the arm of a patient. The band has a highly visible color code to indicate a certain care alert condition. The band is of synthetic paper and has adhesive on at least one end. The bands may be computer processed by mounting them on a length of pin feed computer paper. Charts for the color coded alert condition arm bands are provided. The charts have a list of care conditions which require early warning. A colored flag is mounted on the chart, one flag being mounted for each condition listed, all of the flags being of different colors. Charts may be mounted in convenient places for persons providing care to patients so that they can interpret corresponding color coded arm bands on the patients.

1 Claim, 3 Drawing Sheets

COLOR CARE CODED PATIENT IDENTIFICATION SYSTEM

This invention relates to color-coded wrist bands, adapted to be mounted on the limb of a patient for the purpose of providing an instantaneous alert to a "specific" care condition.

BACKGROUND

Hospital patients generally have identification wrist bands which generally contain their names and patient number. In order to find conditions affecting the patient, the doctor or nurse must consult a chart, which is generally mounted on the foot of a hospital bed. This could cause a certain time delay, which may be critical in an emergency.

The charts are also a source of mistakes, for instance; the charts may be misplaced, or placed on the wrong bed. Also, the patient may be asleep, unconscious, unable to communicate, or temporarily out of the room The careless use of charts can give rise to mistakes, such as providing the wrong medication or treatment.

THE INVENTION

The present invention provides an instant alert warning as to one or more conditions affecting the patient, such as; allergies round the clock medication, emergency room priority treatment, assistance walking, bad heart, deaf, epileptic, not English speaking, living will, dietary requirement, confused, disoriented, etc.

PRIOR ART

The following prior art was found:

| | |
|---|---|
| 1,991,673 | 2,641,074 |
| 3,330,057 | 4,377,047 |

The one reference patent found was U.S. Pat. No. 2,641,074, which provides a color insert for an arm band, the colors being blue and pink to indicate the sex of a baby.

OBJECTS OF THE INVENTION

A principal object of the invention is to provide new and improved means and methods for providing an instantaneous indication to alert the care provider to any condition that the patient has requiring specific care.

Another object of the invention is to provide new and improved arm or leg bands for patients which are color coded to provide a care alert.

Another object of the invention is to provide new and improved color coded care alert arm or leg bands which are mounted on a length of pin feed computer paper, each arm or leg band being secured to the sheet of paper with adhesive; and a plurality of flags of corresponding colors, one flag being mounted next to each arm or leg band, whereby the arm or leg bands may be computer processed and any desirable information written on the arm or leg bands.

A flag is also placed on the patient's chart as an additional method of alert to a patient's special or priority needs.

These, and other objects of the invention, will be apparent from the following specification and drawings, of which FIG. 1 is a front view of an embodiment of the invention.

Figures 1, 2:
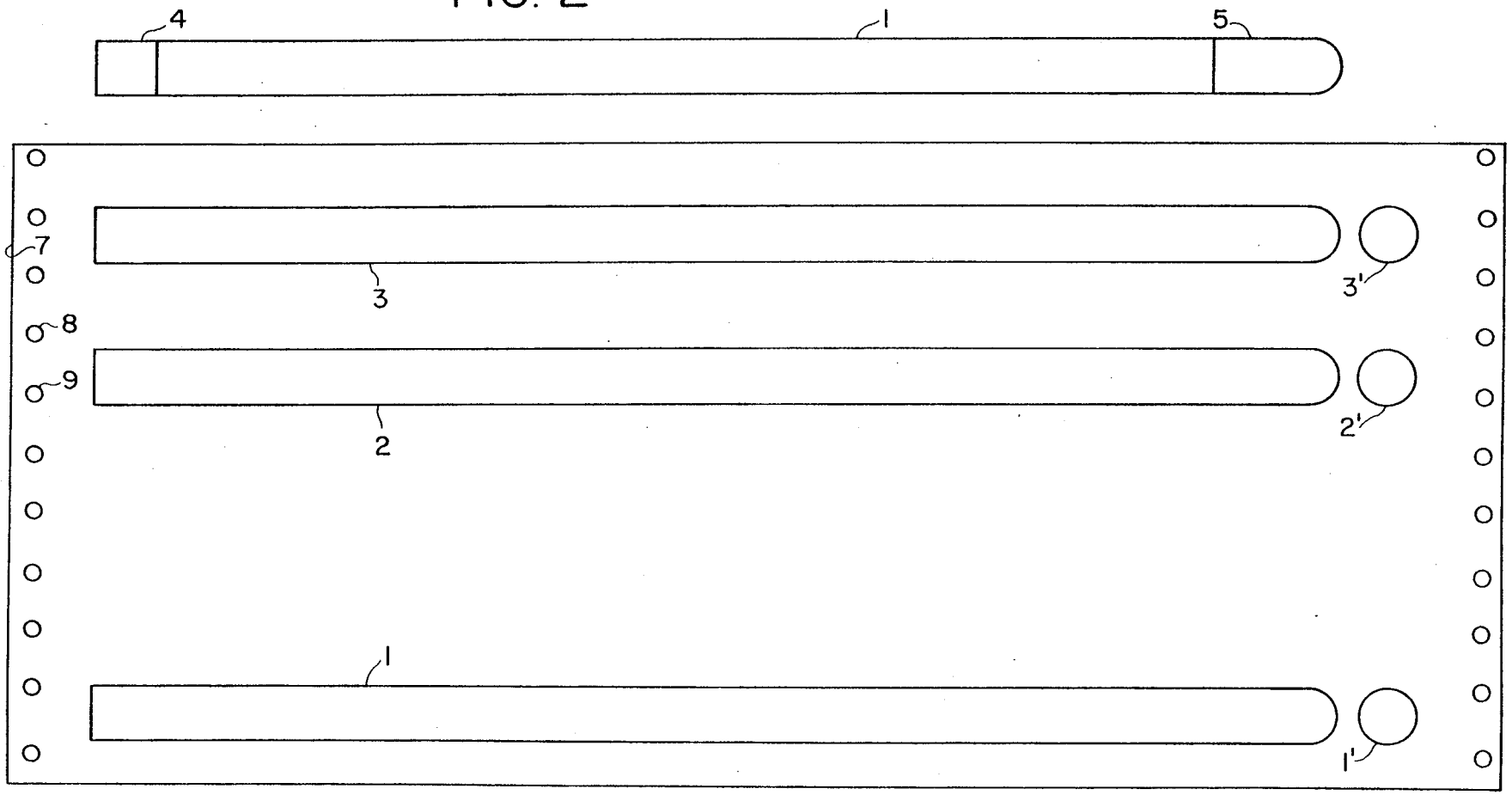
FIG. 2 is a back view of the embodiment of FIG. 1, showing adhesive attached thereto.

Referring to the drawings, FIG. 1 shows a plurality of arm or leg bands 1, 2 & 3. Each arm or leg band has a distinctively different color, for instance; red, green and blue, representing just a few of the many colors which may be used.

FIG. 2 shows a rear view of an arm or leg band as shown in FIG. 1 The back of the arm or leg band has an area of surgical adhesive 4 at one end and may have another area of adhesive 5 at the other end.

Figure 4:
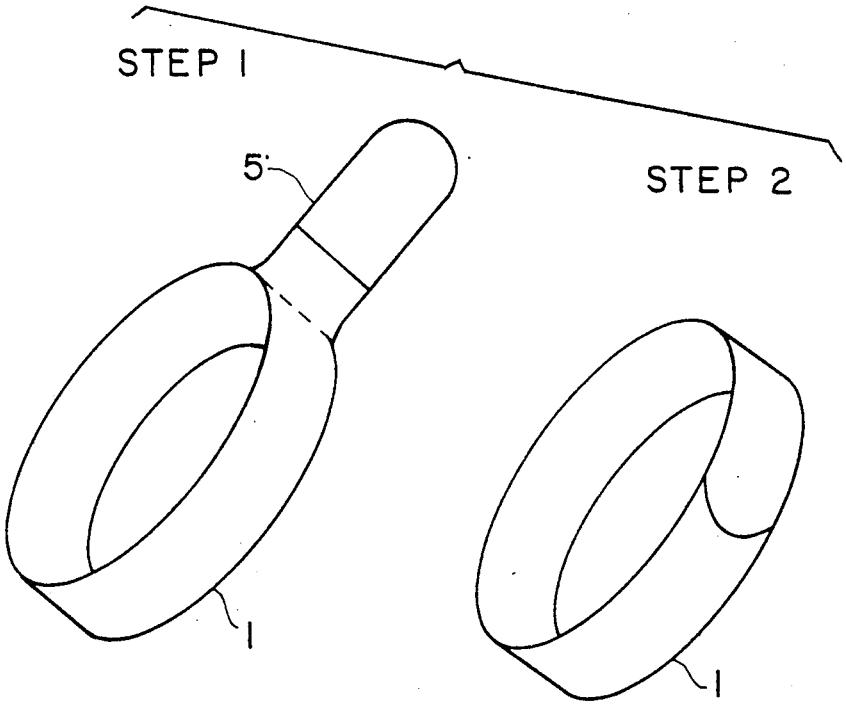
FIG. 4 is a diagram illustrating use of the invention.

The bands are made long enough to fit around the arm, or possibly the leg, of a patient and are long enough so that the adhesive portions at the end of the band will overlap and seal onto the other end of the band. See Steps 1 & 2, FIG. 4. Bands can also be attached to bed posts or wall behind the patient's bed.

As shown in FIG. 1, the arm or leg bands are preferably provided on a sheet of pin feed computer paper 7, with pin feed holes 8, 9, etc This arrangement permits the arm bands to be computer processed so that any additional desired information may be printed on the arm or leg bands by the computer.

The computer sheet also has a plurality of circular flags 1', 2' & 3' , each flag having a color matching its corresponding band 1, 2 & 3, respectively.

The flags have adhesive so that they may be conveniently mounted any place desirable, such as on the end of the bed or on a patient's chart.

The arm or leg bands are preferably about 10" long and 4/8" to ¾" wide. Surgical adhesive is applied to the back at each end, extending about ¾" to 1".

The bands are preferably made of synthetic paper, which is a waterproof product such as Ascot, manufactured by DuPont and Appleton Paper Co.; Kimdura, manufactured by Kimberly Clark Paper Co.; or Teslin, manufactured by Pittsburgh Plate and Glass Co. These synthetic papers are made from polyolyfins, or similar materials such as polypropylene, and are waterproof and chemically resistant, and of the type commonly used for maps and other applications where resistance to elements is important.

The colors are preferably bright colors; such as red, green, orange, etc , and preferably have fluorescent and/or phosphorescent characteristics.

These colors are in themselves a form of language, recognized universally by all races and dialects and it is hoped that this "alert code", once established, could be instituted nationwide and internationally as well This would facilitate consistent health care over a wide range of patient care facilities and make transition from nursing home to hospital care easier.

Figure 3:
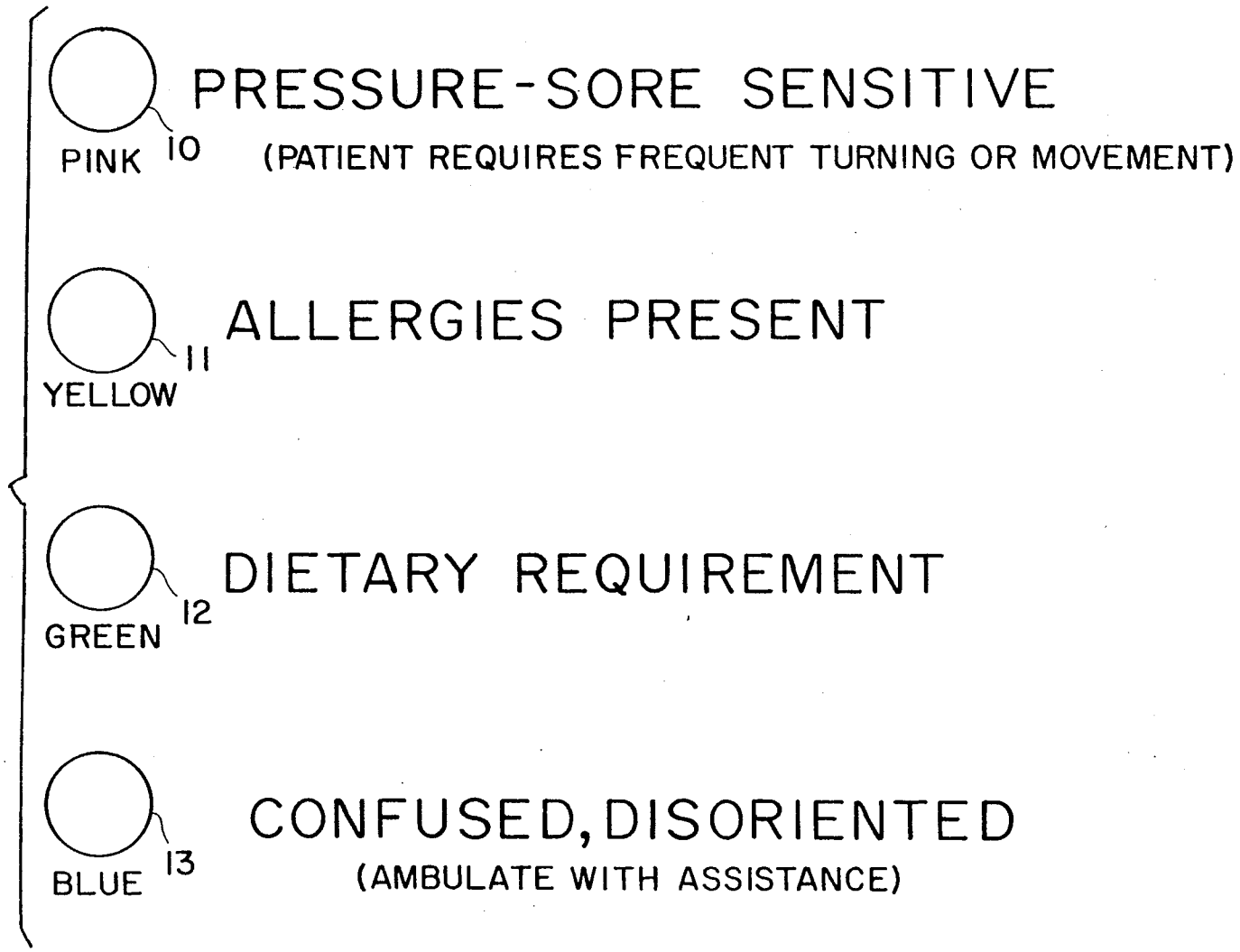
FIG. 3 shows a front view of a color coded chart to facilitate use of the arm or leg bands of the present invention.

FIG. 3 shows a typical chart, which is adapted to facilitate the use of the system. The chart lists various conditions that the care provider should be alerted to, such as; sensitivity to bed sores, allergies, dietary requirements or that the patient is confused and disoriented, or suffers from some other disability which would affect the care required. Colored flags or discs 10–13 highlights the alert condition.

These charts may be placed in convenient places where the care providers, such as; doctors, nurses, attendants and any staff member will become familiar with the different color coding so that they will instantly be aware of any condition requiring special care.

This system will significantly cut down on risk of negligence cases in hospitals and nursing care facilities. It will also make the most efficient use of staff and time.

Insurance companies are expected to offer a reduction in premium, thereby producing an incentive to institute said system.

I claim:

1. Hospital identification bands adapted to be mounted on a patient and bed rails in combination with an alert chart for correlating with said bands comprising:

a strip of pin feed computer paper having a plurality of color coded synthetic paper bands adhered thereon in parallel, and a first set of color coded flags adhesively mounted adjacent to said bands on said strip of paper, said flags having the same color as the respective bands; and a chart having a list of care conditions, and a second set of color coded flags adhesively mounted on said chart, one flag being mounted for each condition listed, all of said flags being of different colors, said first and second sets of color coded flags being identical, whereby said chart may be mounted in a convenient place for persons providing care to patients so that anyone can interpret corresponding color coded bands with said care conditions listed on said chart.

* * * * *